US008028791B2

(12) United States Patent
Kliegle et al.

(10) Patent No.: US 8,028,791 B2
(45) Date of Patent: Oct. 4, 2011

(54) SOUND REFLECTIVE ACOUSTIC PANEL

(75) Inventors: Dennis R. Kliegle, Holcombe, WI (US); Alfonso E. Perez, New Brighton, MN (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 84 days.

(21) Appl. No.: 12/122,767

(22) Filed: May 19, 2008

(65) Prior Publication Data

US 2008/0289899 A1 Nov. 27, 2008

Related U.S. Application Data

(60) Provisional application No. 60/931,226, filed on May 22, 2007.

(51) Int. Cl.

| | |
|---|---|
| ***E04B 1/99*** | (2006.01) |
| ***E04B 1/343*** | (2006.01) |
| ***E04B 1/82*** | (2006.01) |
| ***E04B 7/14*** | (2006.01) |
| ***E04B 9/18*** | (2006.01) |
| *E04B 1/74* | (2006.01) |
| *E04B 7/00* | (2006.01) |
| *E04B 9/22* | (2006.01) |

(52) U.S. Cl. ..... 181/30; 181/287; 181/295; 52/22; 52/506.06

(58) Field of Classification Search ..... 181/30, 181/287, 293, 295; 52/6, 22, 144, 145, 506.6, 52/506.5, 506.06

See application file for complete search history.

(56) References Cited

U.S. PATENT DOCUMENTS

| | | | | | |
|---|---|---|---|---|---|
| 2,556,884 | A | * | 6/1951 | Muller | 181/290 |
| 2,731,374 | A | * | 1/1956 | De Reus | 428/169 |
| 3,221,835 | A | * | 12/1965 | Wenger | 181/287 |
| 3,316,999 | A | * | 5/1967 | Jaffe et al. | 181/30 |
| 3,321,877 | A | | 5/1967 | Alexieff | |
| 3,409,099 | A | * | 11/1968 | Wenger et al. | 181/30 |
| 3,435,909 | A | * | 4/1969 | Urch et al. | 181/30 |
| 3,483,944 | A | * | 12/1969 | Handy, Jr. | 181/30 |
| 3,713,474 | A | | 1/1973 | Orlando | |
| 3,976,269 | A | | 8/1976 | Gupta | |
| 4,019,295 | A | | 4/1977 | Derner et al. | |
| 4,047,337 | A | | 9/1977 | Bergstrom | |
| 4,083,153 | A | * | 4/1978 | Sumpter | 52/28 |
| 4,238,097 | A | | 12/1980 | Clausen et al. | |
| 4,278,145 | A | * | 7/1981 | Eade et al. | 181/30 |
| 4,290,332 | A | | 9/1981 | Schoeffling, Jr. | |
| 4,319,661 | A | * | 3/1982 | Proudfoot | 181/295 |
| 4,356,880 | A | * | 11/1982 | Downs | 181/30 |
| 4,480,715 | A | * | 11/1984 | Brooks | 181/287 |
| 4,509,442 | A | | 4/1985 | Gregory | |
| 4,515,238 | A | | 5/1985 | Baker | |
| 4,516,656 | A | | 5/1985 | Fleshler | |
| 4,671,811 | A | * | 6/1987 | Cadwell et al. | 55/355 |
| 4,678,487 | A | * | 7/1987 | Cadwell et al. | 55/385.1 |
| 4,805,724 | A | | 2/1989 | Stoll et al. | |
| 4,821,787 | A | * | 4/1989 | Swanson | 160/135 |

(Continued)

*Primary Examiner* — Edgardo San Martin

(74) *Attorney, Agent, or Firm* — Calfee, Halter & Griswold LLP

(57) ABSTRACT

A sound reflective acoustic panel includes a panel having a scored surface. The scored surface includes a plurality of substantially parallel spaced apart kerfs. The kerfs are configured to allow the panel to flex. A plurality of support ribs are attached to the scored surface of the panel. The plurality of support ribs have a curved shape and a length. A suspension mechanism is attached to the support ribs and is suitable for mounting the panel to a building support surface.

14 Claims, 8 Drawing Sheets

U.S. PATENT DOCUMENTS

| | | | | | |
|---|---|---|---|---|---|
| 4,858,721 | A | | 8/1989 | Autie et al. | |
| 5,024,290 | A | * | 6/1991 | Birker | 181/293 |
| 5,217,771 | A | | 6/1993 | Schmanski et al. | |
| 5,356,346 | A | * | 10/1994 | Katje et al. | 473/54 |
| D365,825 | S | | 1/1996 | Abraham | |
| 5,525,766 | A | | 6/1996 | Atcheson et al. | |
| 5,530,211 | A | * | 6/1996 | Rogers et al. | 181/30 |
| 5,622,011 | A | * | 4/1997 | Jines | 52/66 |
| 5,987,823 | A | * | 11/1999 | Zarnick | 52/6 |
| 6,006,476 | A | * | 12/1999 | Zarnick | 52/6 |
| 6,364,250 | B1 | * | 4/2002 | Brinck et al. | 244/119 |
| D465,235 | S | | 11/2002 | Heid | |
| 6,971,210 | B2 | * | 12/2005 | Kliegle et al. | 52/506.07 |
| 7,076,928 | B2 | * | 7/2006 | Kliegle et al. | 52/506.09 |
| 7,329,456 | B2 | * | 2/2008 | Tilton et al. | 428/212 |
| 7,406,802 | B2 | * | 8/2008 | Stackenwalt et al. | 52/222 |
| 7,661,511 | B2 | * | 2/2010 | Hasegawa et al. | 181/293 |
| 2005/0076585 | A1 | * | 4/2005 | Kelly | 52/144 |
| 2008/0190690 | A1 | * | 8/2008 | Waters | 181/287 |

* cited by examiner

SOUND REFLECTIVE ACOUSTIC PANEL

TECHNICAL FIELD

This invention relates generally to managing sound within the confines of a large venue such as an auditorium, concert hall or arena, and more specifically relates to reflecting sound waves to obtain desirable acoustics.

BACKGROUND OF THE INVENTION

Large venues, such as for example auditoriums, concert halls, zoo amphitheaters, band shells and arenas often host speakers and musical acts. The speakers and musical acts typically perform on a stage located in specific areas within the auditorium, concert hall or arena. The sound waves emanating from the speakers and musical acts are often amplified and travel to all parts of the venue. In order to achieve desirable sound characteristics, the amplified sound waves are managed by purposely directing the sound waves in specific directions. One method of directing sound waves is to reflect the sound waves away from undesirable locations, such as ceilings, toward more desirable locations, such as the seating areas for the venue participants. It would be advantageous if the sound waves in the undesirable locations could be more efficiently reflected to more desirable locations.

SUMMARY OF THE INVENTION

The above objects as well as other objects not specifically enumerated are achieved by a sound reflective acoustic panel. The sound reflective acoustic panel comprises a panel having a scored surface. The scored surface includes a plurality of substantially parallel spaced apart kerfs. The kerfs are configured to allow the panel to flex. A plurality of support ribs are attached to the scored surface of the panel. The plurality of support ribs have a curved shape and a length. A suspension mechanism is attached to the support ribs and is suitable for mounting the panel to a building support surface.

According to this invention there is also provided a method of ganging a plurality of sound reflective acoustic panels. The method includes providing a plurality of sound reflective acoustic panels. Each panel has a scored surface. The scored surface of each panel includes a plurality of parallel spaced apart kerfs. The kerfs are configured to allow each panel to flex. Each panel has a plurality of support ribs. Each support rib has a curved shape and a length. The flexed panels are attached to each support rib. A plurality of joining clips are attached to the scored surface of each panel. Each joining clip has an alignment lip. The joining clips are alternately attached to one panel and additional joining clips are alternately attached to an adjacent panel. The adjacent panels are aligned. The plurality of joining clips are attached to the mated panel.

According to this invention there is also provided a sound reflective band leader station comprising a frame configured into a left wing portion, a center portion and a right wing portion. A plurality of sound reflective panels are attached to the frame. The plurality of sound reflective panels attached to the left wing portion, center portion and right wing portion cooperate to define a band leader area. A music stand and a platform are attached to the frame. Sound waves are reflected away from the band leader area.

Various objects and advantages of this invention will become apparent to those skilled in the art from the following detailed description of the invention, when read in light of the accompanying drawings.

DETAILED DESCRIPTION OF THE INVENTION

Figure 1:
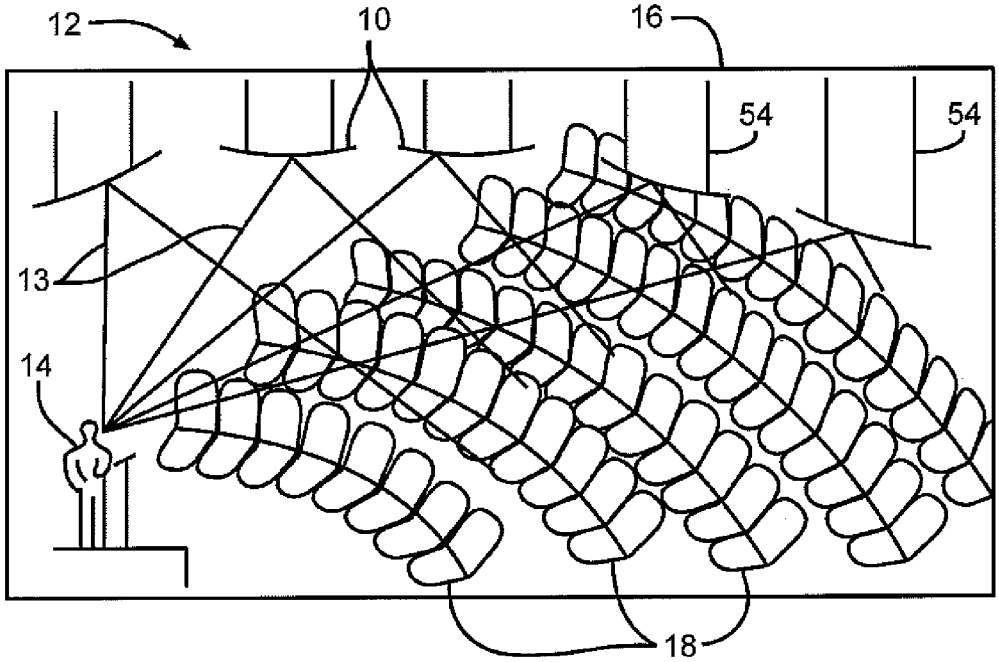
FIG. 1 is a perspective view of a concert venue illustrating sound reflective acoustic panels.

Referring now to the drawings there is illustrated in FIG. 1 a first embodiment of a sound reflective acoustical panel indicated generally at 10. As will be explained in detail below, the sound reflective acoustical panel 10 is adapted to reflect sound from an undesirable location to a more desirable location.

As shown generally in FIG. 1, a venue 12 such as for example a concert hall, auditorium, or sports arena may host an event in which a plurality of sound waves 13 are created. The sound waves 13 emanate from a source 14, such as for example a speaker or from music performed by a musical group. Optionally, the sound waves 13 can be amplified by amplifying equipment (not shown) such as for example microphones and speakers. In another event such as for example a hockey game or basketball game, the source 14 of the sound waves 13 may be the attending spectators. As shown in FIG. 1, the sound waves 13 can travel to undesirable locations, such as for example the ceiling 16 of the venue 12. In order to achieve desirable sound characteristics for the event spectators, the sound waves 13 are managed by reflecting the sound waves 13 in specific directions. In the illustrated embodiment, the sound waves 13 are reflected away from an undesirable location, such as the ceiling 16, toward more desirable locations, such as seating 18 for the venue participants. As further shown in FIG. 1, the sound waves 13 are reflected from the ceiling 16 or other undesirable locations by the sound reflective acoustical panels 10.

Figure 2:
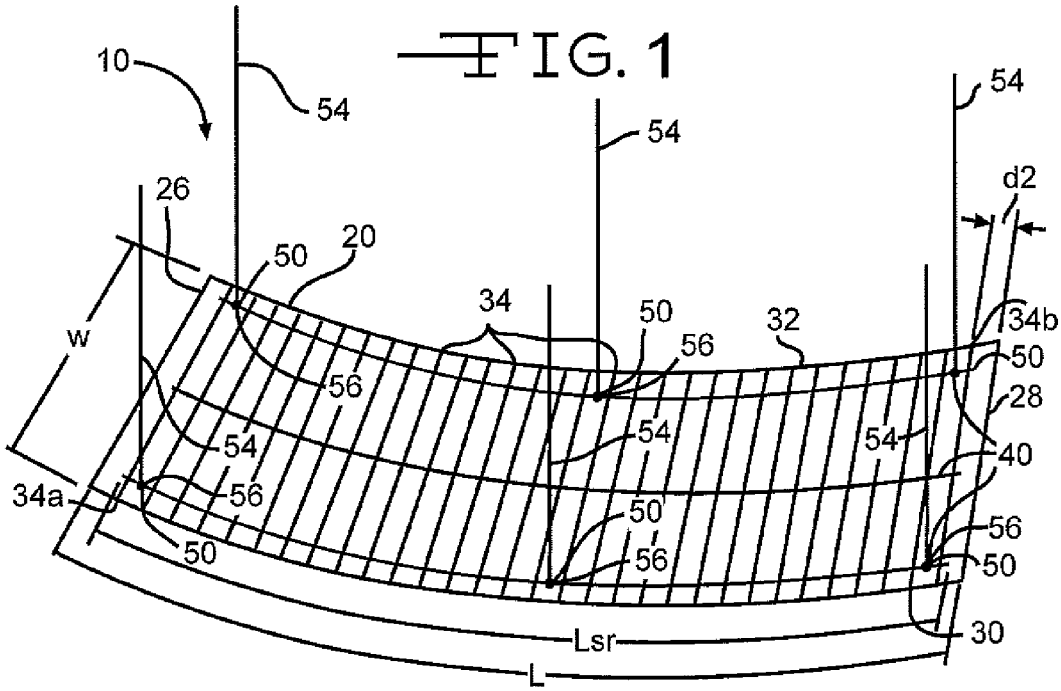
FIG. 2 is a perspective view of the sound reflective acoustic panels of FIG. 1.
Figure 3:
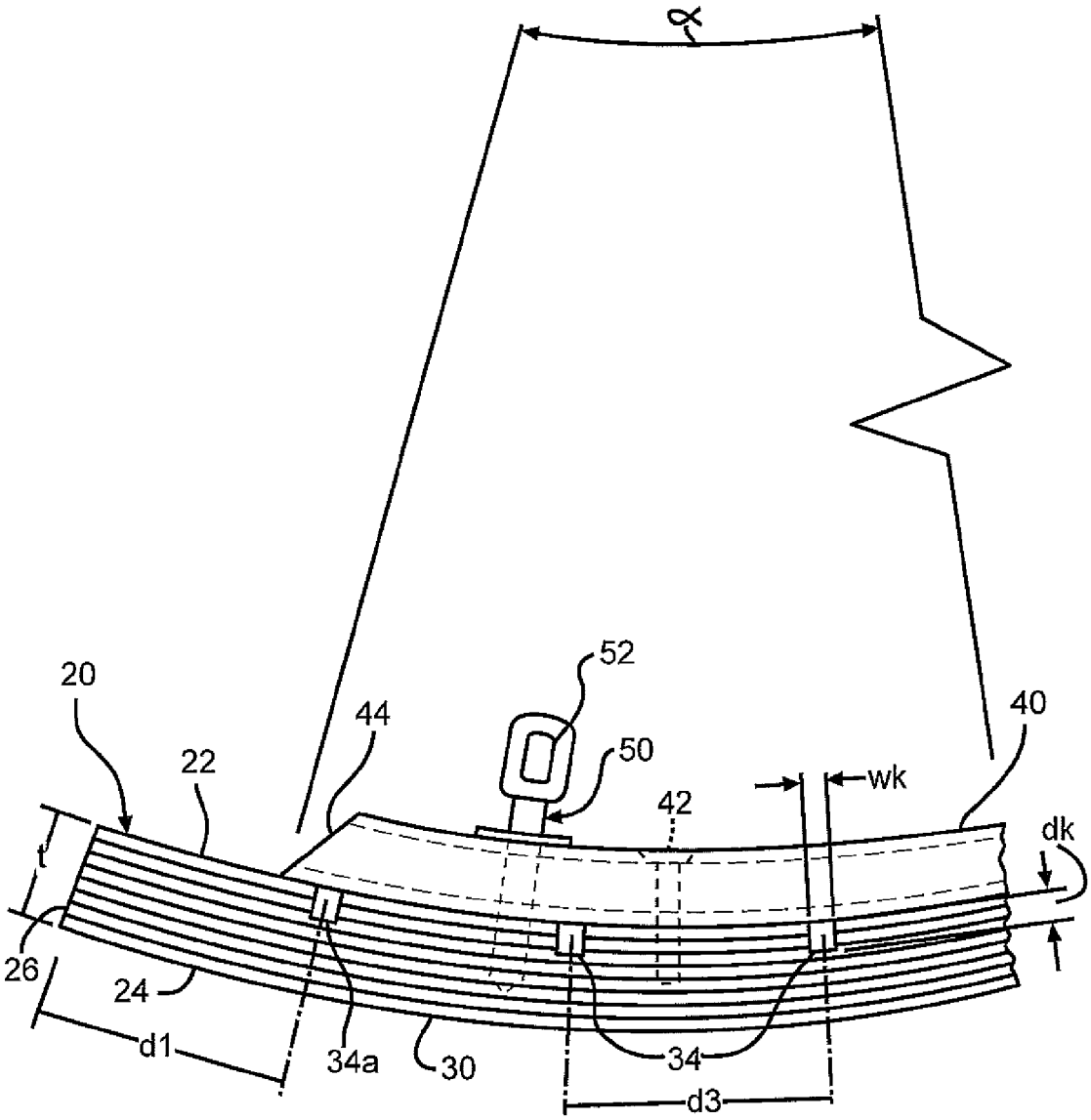
FIG. 3 is a side view in elevation of a portion of the sound reflective acoustic panel of FIG. 1.
Figure 4:
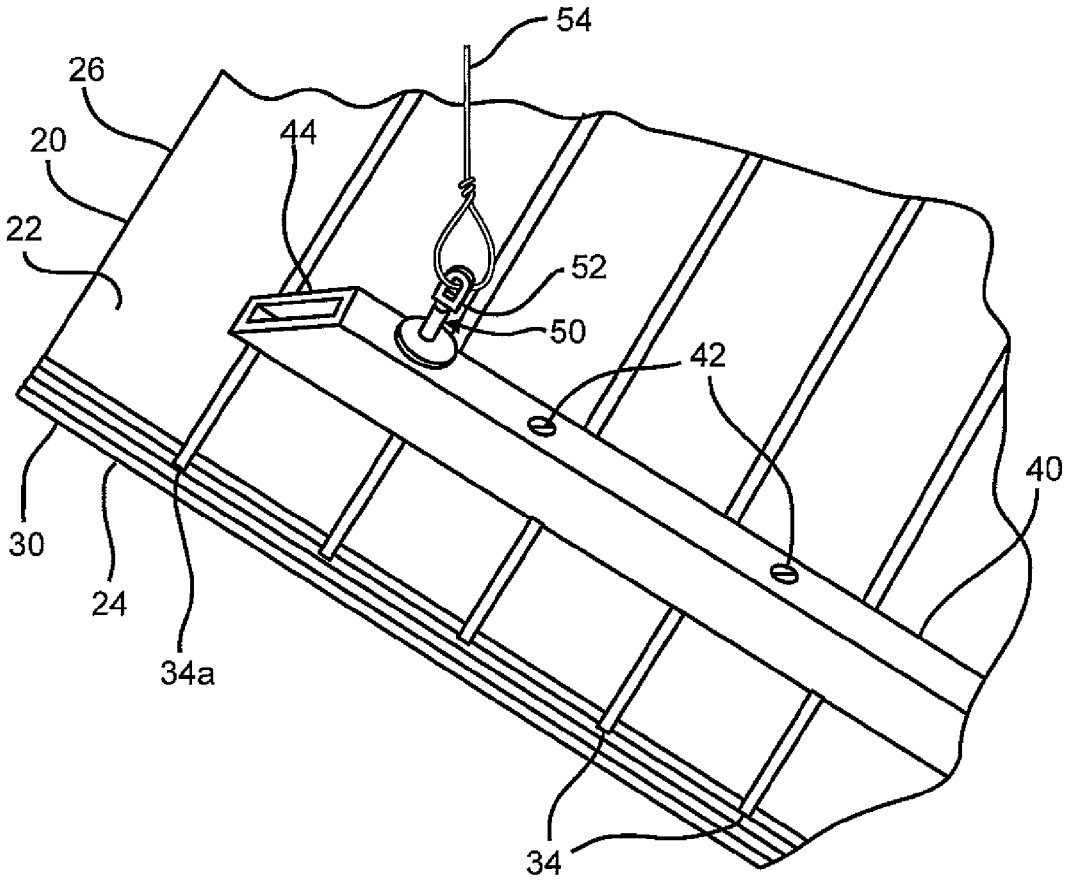
FIG. 4 is a perspective view of a portion of the sound reflective acoustic panel of FIG. 1.

As shown in FIGS. 2-4, the sound reflective acoustical panels 10 include a panel 20. In the illustrated embodiment, the panel 20 has a thickness t sufficient to provide the desired acoustical reflection. In one embodiment, the thickness t of the panel 20 is 0.75 inches. Alternatively, the thickness t of the panel 20 can be any thickness sufficient to provide the desired acoustical reflection.

As shown in FIGS. 2-4, the sound reflective acoustical panels 10 include a panel 20. In one embodiment, the panel 20 is made of engineered plywood, such as for example Medium Density Overlay (MDO) plywood, which is commonly available from lumber suppliers. In another embodiment, the panel 20 can be made of another material, such as for example a polymer material which can optionally be reinforced with a reinforcement material, such as for example fiberglass, sufficient to provide the desired acoustical reflection. As shown in FIG. 2, the panel 20 has square corners. Alternatively, the panel 20 can have radiused corners or other corner shapes.

Referring again to FIG. 2, the panel 20 has a length l and a width w. In the illustrated embodiment, the length l of the panel 20 is 96 inches and the width w of the panel 10 is 48 inches. In another embodiment, the panel 20 can have a length l that this more or less than 96 inches and a width w that is more or less than 48 inches. As will be explained below in more detail, a plurality of panels 20 may be joined resulting in an assembled panel, having a length that is more than 96 inches and a width that is more than 48 inches.

As shown in FIG. 2, the panel 20 has a scored surface 22 and a plain surface 24. The panel 20 also has a left edge 26, a right edge 28, a front edge 30 and a rear edge 32. In the illustrated embodiment the left edge 26, right edge 28, front edge 30 and rear edge 32 have a square edge profile. Alternatively, the left edge 26, right edge 28, front edge 30 and rear edge 32 can have another edge profile, such as for example a bevel, a miter or a radius.

The scored surface 22 includes a plurality of parallel kerfs 34. The kerfs 34 are configured to allow the panel 20 to be flexed to a desired arc. As best shown in FIG. 2, the plurality of parallel kerfs 26 extend perpendicular to the length l of the panel 20 from the front edge 30 of the panel 20 to the rear edge 32 of the panel 20. As best shown in FIG. 3, a first kerf 34*a* is positioned at a distance d1 from the left edge 26 of the panel 20. In one embodiment, the distance d1 is about 3 inches. In another embodiment, the distance d1 can be more or less than 3 inches. In a similar manner as shown in FIG. 2, a second kerf 34*b* is positioned at a distance d2 from the right edge 28 of the panel 20. In one embodiment, the distance d1 is about 3 inches. In another embodiment, the distance d1 can be more or less than 3 inches. As best shown in FIG. 3, the plurality of parallel kerfs 34 are spaced apart a distance d3. In the illustrated embodiment, the distance d3 is about 1 inch. In another embodiment, the distance d3 can be more or less than 1 inch.

As further shown in FIG. 3, each kerf 34 has a width wk and a depth dk. In the illustrated embodiment, the width wk of each kerf 34 is about 0.25 inches and the depth dk of each kerf 34 is about 0.50 inches. Alternatively, the width wk of each kerf 34 can be more or less than 0.25 inches and the depth dk can be more or less than 0.50 inches such that the panel 20 can be flexed to the desired arc.

Referring again to FIGS. 2-4, the sound reflective acoustical panel 10 also includes a plurality of support ribs 40. As best shown in FIG. 3, the support ribs 40 are formed into the shape of an arc having a radius α. The support ribs 40, having an arc α, are attached to the flexed panel 20, and support the flexed panel 20 in the shape of the arc having radius α. In the illustrated embodiment, the arc has a minimum radius α of 10 feet. In another embodiment, the arc can have a minimum radius α or more than or less than 10 feet. As will be explained in detail below, the support ribs 40 can have any desired shape. In the illustrated embodiment, the sound reflective acoustical panel 10 has three spaced apart support ribs 40. In another embodiment, the sound reflective acoustical panel 10 may have more or less than three spaced apart support ribs 40.

As shown in FIG. 4, each support rib 40 has a rectangular cross-sectional shape. In the illustrated embodiment, the cross-sectional shape is a square tube. Alternatively, the cross-sectional shape of the support ribs 40 can be another shape, such as for example a channel or an angle, sufficient to support the flexed panel 20 in the desired shape.

As shown in FIG. 2, the support ribs 40 have a length lsr. The length lsr is configured to be shorter than the length l of the panel 20 such that the support ribs 40 are not visible when the sound reflective acoustical panel 10 in mounted to the ceiling 16 or other building support surfaces.

As shown in FIGS. 3 and 4, the support ribs 40 have ends 44. The ends 44 of the support ribs 40 are configured such that the support ribs 40 are not visible when the sound reflective acoustical panel 10 is mounted to ceilings 16 or other building support surfaces. In the illustrated embodiment, the ends 44 have a beveled shape. Alternatively, the ends 44 can have another shape, such as for example a rounded shape, sufficient so as to not be visible when the sound reflective acoustical panel 10 in mounted to ceilings 16 or other building support surfaces.

As shown in FIGS. 3 and 4, the support ribs 40 are attached to the panel 20 by fasteners 42. The fasteners 42 are configured to attach the support ribs 40 to the scored surface 22 of the panel 20 such that the fasteners 42 are not visible from the plain surface 24. In the illustrated embodiment, the fasteners 42 are #10 1⅝ inch pan head wood screws. In another embodiment the fasteners 42 can be another device or structure, such as for example self-tapping sheet metal screws, clips or clamps, sufficient to attach the support ribs 40 to the panel 20. As best shown in FIG. 4, the fasteners 42 are spaced apart a distance ds along the length of the support ribs 40.

The scored surface 22 and the plain surface 24 of the panel 10 can be finished as desired by the user. In one embodiment, the plain surface 24 of the panel can be covered with a Class A-rated fabric for decorative purposes. Alternatively, the plain surface 24 of the panel 24 can be covered with a veneer or laminate. In another embodiment, the plain surface 24 can be covered with a gel coat finish. In yet another embodiment, the plain surface 24 of the panel 20 can be painted. Similarly, the scored surface 22 can be finished as desired by the user.

As shown in FIGS. 3 and 4, a plurality of panel anchors 50 are attached to the support ribs 40 and the panel 20. The panel anchors 50 include an aperture 52. The panel anchors 50 are configured such that suspension members 54 attach to the aperture 52 and allow the sound reflective acoustical panels 10 to be suspended from the ceiling 16 or other building support surfaces. In the illustrated embodiment, the panel anchors 50 are self-drilling acoustical anchors commonly available from suppliers of suspended ceilings. In another embodiment, the panel anchors 50 can be any device or structure sufficient to attach to the suspension members 54 and allow the sound reflective acoustical panels 10 to be suspended from the ceiling 16 or other building support surfaces.

As mentioned above, one end of the suspension member 54 attaches to the sound reflective acoustical panel 10 and the second end attaches to a ceiling 16 or other building support surface. In the illustrated embodiment, the suspension member 54 is a No. 12 gauge galvanized steel wire. In another embodiment the suspension member 54 can be any device or structure, such as for example a threaded rod, sufficient to suspend the sound reflective acoustical panel 10 from the ceiling 16 or other building support surface.

As shown in FIG. 2, the panel anchors 50 are mounted to the panel 20 at the anchor points 56. The anchor points 56 are configured to suspend the sound reflective acoustical panels 10 at a desired angle and orientation with respect to the ceiling 16 or other building support surface. In the embodiment illustrated in FIG. 2, the anchor points 56 are located in the panel corners and at intermediate panel locations on the support ribs 40 closest to the front and rear edges, 30 and 32. Alternatively, the anchor points 56 can be located on any support rib 40 and in any panel location sufficient to suspend the sound reflective acoustical panels 10 at the desired angle and orientation. The suspension members 54 can be attached to the ceiling 16 or other building support surface in any convenient manner.

Figure 5:
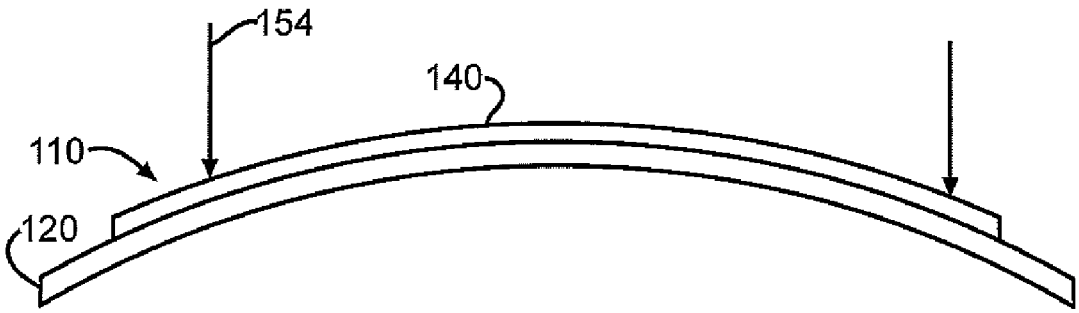
FIG. 5 is a side view in elevation of a second embodiment of the sound reflective acoustic panel of FIG. 1.

As previously mentioned, the sound reflective acoustic panel 10 can have any desired shape. In the embodiment illustrated in FIGS. 1-4, the sound reflective acoustic panel 10 is flexed into a concave shape. Alternatively, the sound reflective acoustic panel 110 can have a convex shape as shown in FIG. 5. In this embodiment, the support ribs 140 have a convex shape and the panel 120 is flexed to match the convex shape of the support ribs 140.

Figure 6:
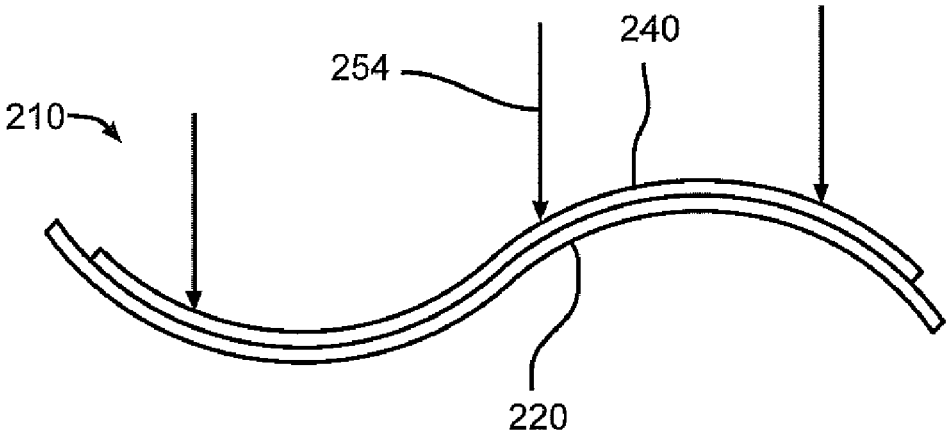
FIG. 6 is a side view in elevation of a third embodiment of the sound reflective acoustic panel of FIG. 1.

In another embodiment as shown in FIG. 6, the sound reflective acoustic panel 210 is flexed into an s shape. In this embodiment, the support ribs 240 have an s shape and the panel 220 is flexed to match the s shape of the support ribs 240.

Figure 7:
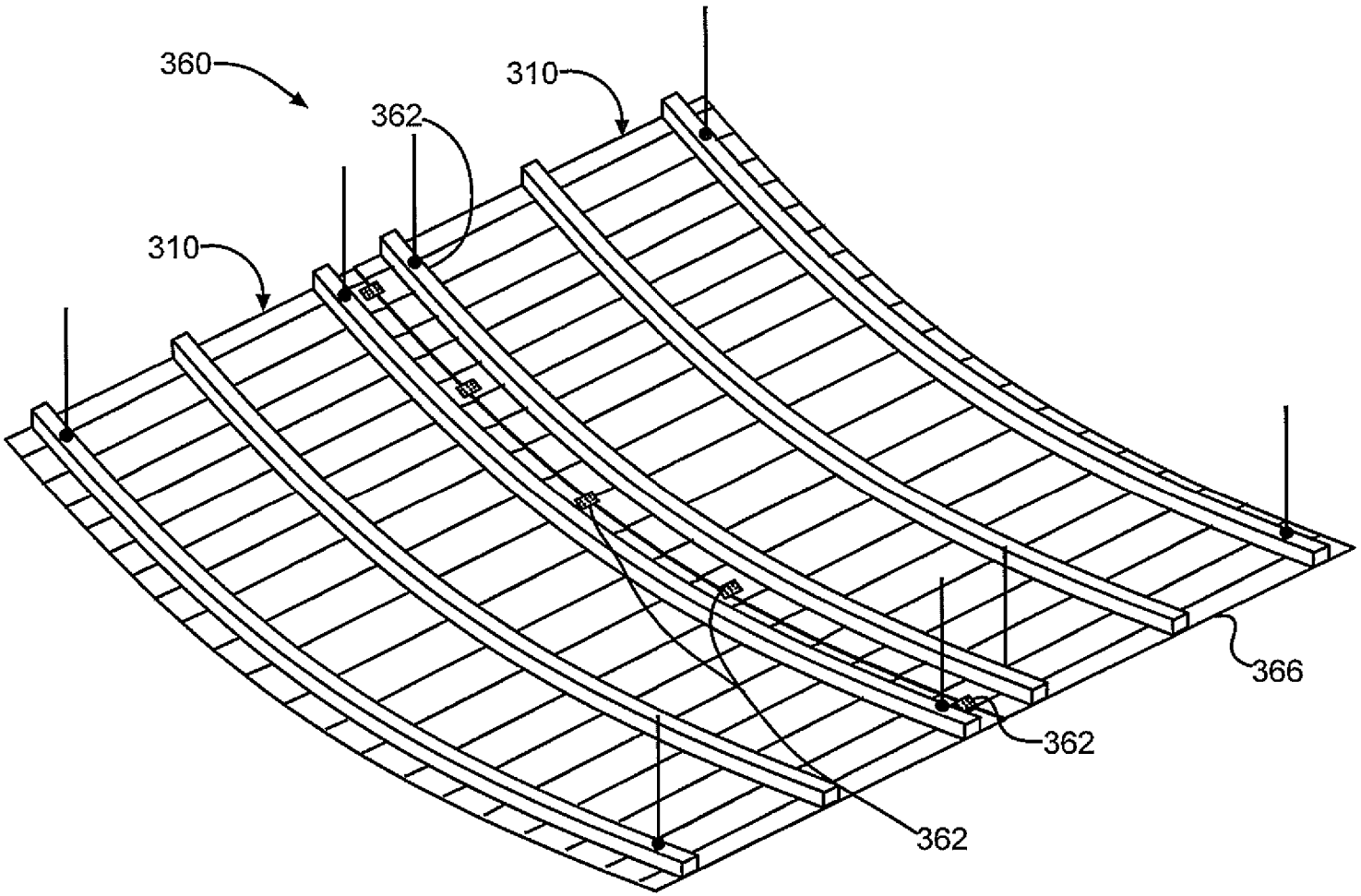
FIG. 7 is a perspective view of ganged sound reflective acoustic panels.

In yet another embodiment as shown in FIG. 7, a plurality of sound reflective acoustic panels 310 are ganged together to form a large sound reflective acoustic panel 360. In this embodiment, a plurality of joining clips 362 are attached to the scored surface 322 of a first sound reflective acoustic panel 364 and a plurality of joining clips 362 are attached to the scored surface 322 of a second sound reflective acoustic panel 366. In this embodiment, the joining clips 362 on the first sound reflective acoustic panel 364 alternate with the joining clips 362 on the second sound reflective acoustic panel 366. The panels, 364 and 366, are aligned and the joining clips 362 are attached to the scored surface 322 of the mated panel, 364 or 366. As shown in FIG. 7, a joining clip 362 is disposed on the scored surface 322 in the middle of the sound reflective acoustic panels 310 such that there is no gap in the middle of the adjoining sound reflective acoustic panels 310. In this manner, multiple sound reflective acoustic panels 310 can be ganged together.

Figure 8:
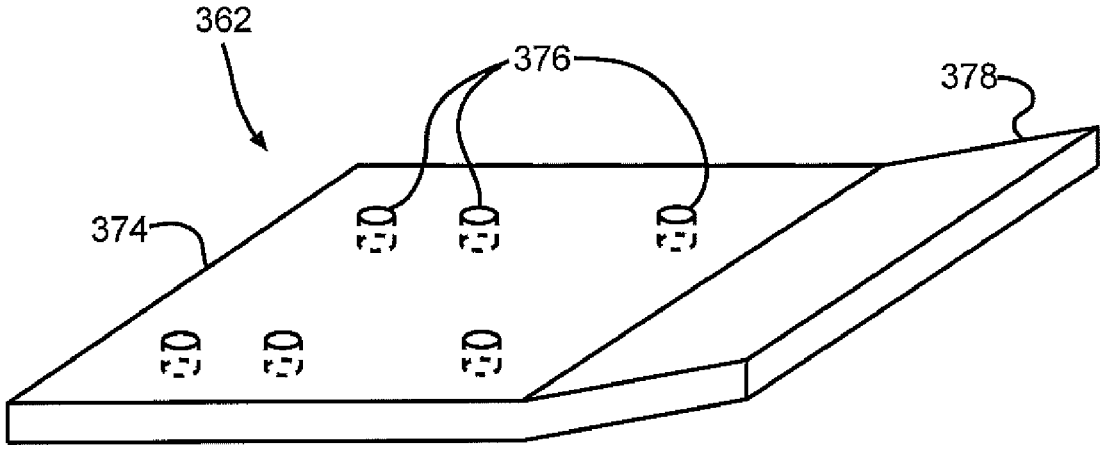
FIG. 8 is a perspective view of sound reflective acoustic panel joining clips.

As shown in FIG. 8, the joining clip 362 includes a plate 374 having a plurality of apertures 366. The plate 364 also includes an alignment lip 368. The alignment lip 368 is configured to engage and align the mated panel, 364 or 366. While the alignment lip 368 shown in FIG. 8 is an angled portion of the plant 364, the alignment lip 368 can have any shape, such as for example a radiused portion, sufficient to engage and align the mated panels, 364 and 366. The plate 364 is configured to connect adjoining sound reflective acoustic panels 310. In one embodiment, the plate 364 is a metallic material. In another embodiment, the plate 364 can be any material, such as for example a polymer, sufficient to connect adjoining sound reflective acoustic panels 310. The apertures 366 are configured for fasteners (not shown). The fasteners can be any device or structure, such as lag screws, sufficient to connect the plate 364 to the sound reflective acoustic panels 310.

Figure 9:
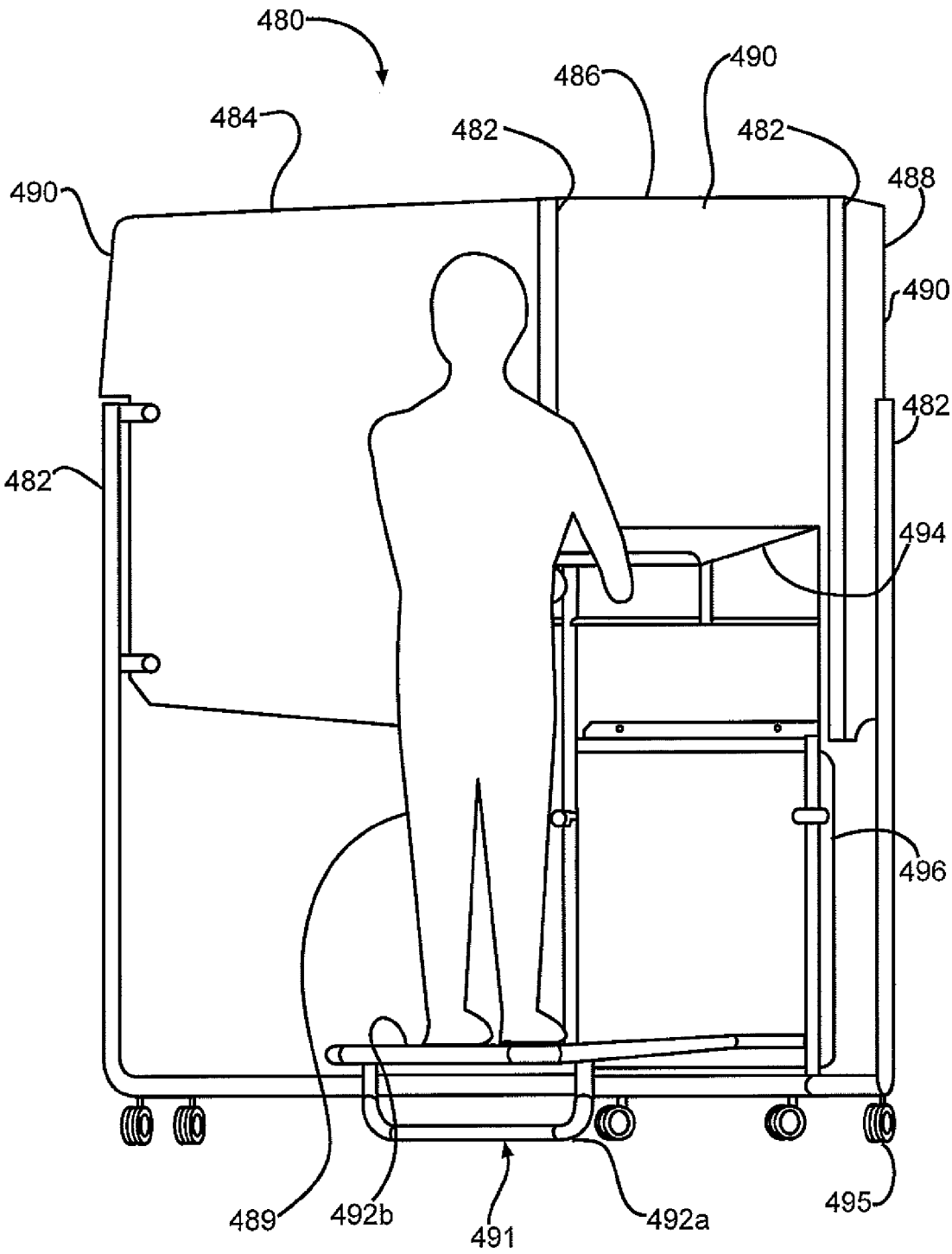
FIG. 9 is a perspective view of a sound reflective band leader station.
Figure 10:
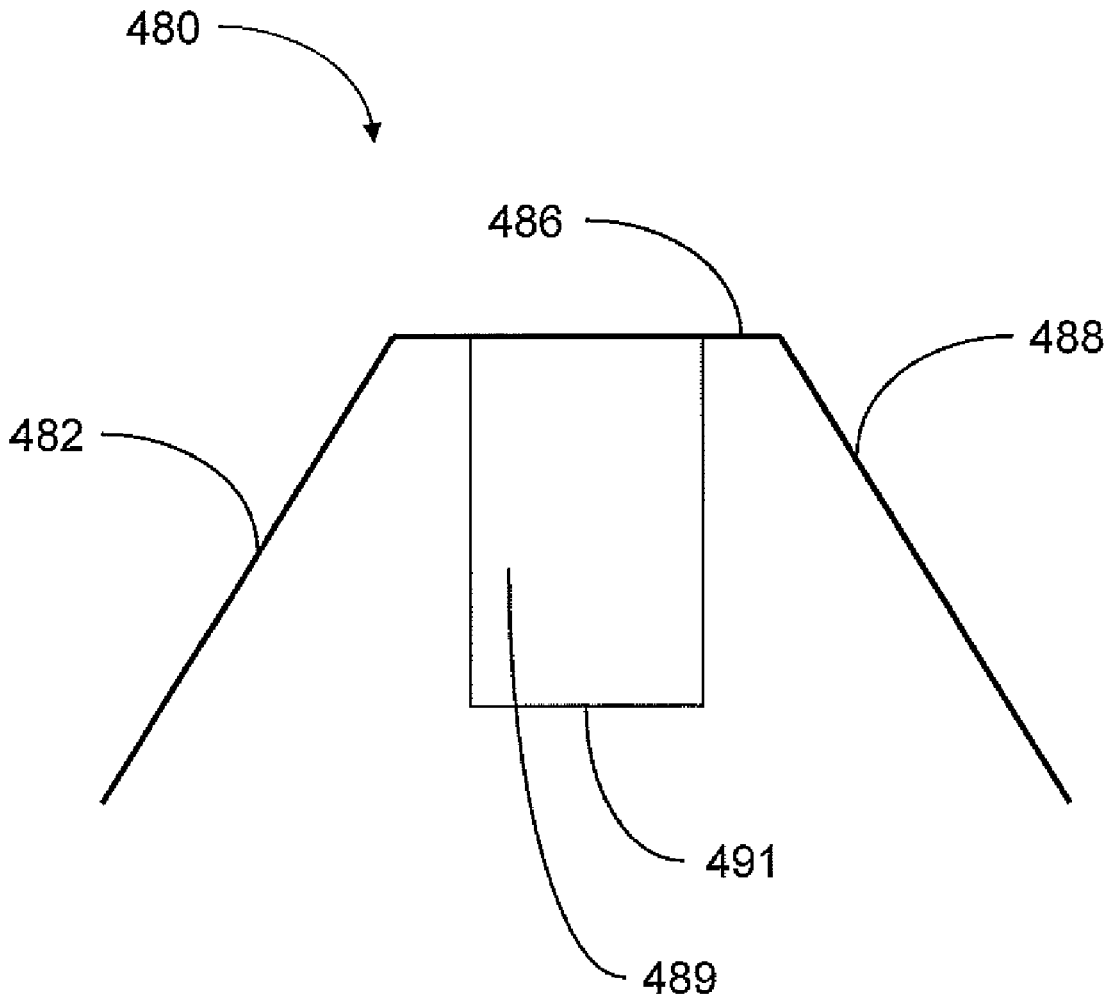
FIG. 10 is a top plan view in elevation of the sound reflective band leader station of FIG. 9.

In another embodiment, a sound reflective band leader station 480 is shown in FIGS. 9 and 10. The sound reflective band leader station 480 is configured to reflect a pre-determined level of sound emanating from a band positioned in front of the sound reflective band leader station 480. While the sound reflective band leader station 480 reflects the sound, a pre-determined level of sound is allowed to pass through the sound reflective band leader station 480 and be received by the band leader as the band leader is positioned within the sound reflective band leader station 480. By reflecting a pre-determined level of sound away from the sound reflective band leader station 480, the sound reflective band leader station 480 helps prevent hearing loss by a band leader while still allowing the band leader to effectively lead the band. The sound reflective band leader station 480 includes a frame 482. The frame 482 is configured to define three portions of the sound reflective band leader station 480, a left wing portion 484, a center portion 486 and a right wing portion 488. As shown in FIGS. 9 and 10, the left wing portion 484, center portion 486 and right wing portion 488 are configured to form a band leader area 489.

The left wing portion 484, center portion 486 and right wing portion 488 of the frame 482 are configured to support sound reflective panels 490. In this embodiment, the frame 482 is made of 1¼ inch tubular steel. In another embodiment, the frame 482 can be made of another material, such as for example aluminum, sufficient to support the sound reflective panels 490. In yet another embodiment, the frame 482 can have another cross-sectional shape, such as for example, a rectangular cross sectional shape, sufficient to support the sound reflective panels 490. In another embodiment, the frame 482 can have a size larger or smaller than 1¼ inch.

The left wing portion 484 of the frame 482 is configured to rotate vertically relative to the center portion 486 of the frame 482. In a similar manner, the right wing portion 488 of the frame 482 is configured to rotate relative to the center portion 486 of the frame 482. Rotation of the left wing and right wing portions, 484 and 488, relative to the center portion 486 allow the defined band leader area 489 to have an adjustable size.

As further shown in FIG. 9, the sound reflective panels 490 are supported by the frame 482 and extend vertically from the top of the band leader area 489 along a portion of the frame 482. The sound reflective panels 490 are configured to reflect a desired amount of sound from the band leader area 489. In one embodiment, the reduction in sound level received by the band leader positioned within the band leader area 489 is about 5 db (decibels). In another embodiment, the reduction in sound received by the band leader positioned within the band leader area 489 can be more or less than about 5 db (decibels).

In the embodiment shown in FIG. 9, the sound reflective panels 490 do not extend the full vertical length of the frame 482. Accordingly, the sound reflective panels 490 reflect a level of sound and allow a level of sound to be received by the band leader. In another embodiment, the sound reflective panels 490 can extend a longer or shorter length along the frame 482 according to the desired level of sound to be received by the band leader within the band leader area 489.

As shown in FIG. 9, the sound reflective panels 490 are substantially flat panels. Alternatively, the sound reflective panels 490 can be another shape, such as for example a curved shape, sufficient to reflect a desired level of sound from the band leader area 489.

As shown in FIG. 9, the sound reflective panels 490 are transparent allowing the band leader to see the band when the band leader is positioned within the band leader area 489. In this embodiment, the sound reflective panels 490 are made from ¼ inch thick transparent polymer. In another embodiment, the reflective panels 490 can be more or less than ¼ inch thick and can be made from another material sufficient to allow the band leader to see the band when the band leader is positioned within the band leader area 489.

As further shown in FIG. 9, the sound reflective band leader station 480 includes a band leader platform 491. In this embodiment, the band leader platform 491 is configured to rotate to a horizontal position to support the band leader and alternatively rotate to a stowed position. The band leader platform 491 includes a platform frame **492*a* and a platform floor 492*b*. In this embodiment, the platform frame 492*a* is made from the 1¼ inch tubular steel as the frame 482. In another embodiment, the platform frame 492*a* can be made from another material. The platform floor 492*b* is configured to support the weight of the band leader. In one embodiment, the platform floor 492*b* is plywood having a thickness of ¾ inches. Alternatively, the platform floor 492*b*** can be another material and another thickness, such as for example, metal or plastic sufficient to support the weight of the band leader.

As further shown in FIG. 9, the sound reflective band leader station 480 includes a music stand 494. The music stand 494 is configured to support sheet music for the band leader. The music stand 494 is mounted to the frame 482. Optionally, the music stand 494 is removable thereby allowing the sound reflective band leader station 480 to be stowed in a compact assembly.

Optionally as further shown in FIG. 9, the sound reflective band leader station 480 includes a plurality of casters 495 configured for moving the sound reflective band leader station 480 to another location. In another embodiment, the sound reflective band leader station 480 can include a plurality of other devices or structures, such as for example slides, configured for moving the sound reflective band leader station 480 to another location.

Optionally, as further shown in FIG. 9, the sound reflective band leader station 480 includes a sound panel 496 configured to absorb a pre-determined level of sound from the front of the sound reflective band leader station 480. In this embodiment, the sound panel 496 is made of sound absorbing material, such as for example fiber insulation. In another embodiment, the sound panel 496 can be another material sufficient to absorb a pre-determined level of sound. As shown in FIG. 9, the sound panel 496 has a square shape. Alternatively, the sound panel 496 can have another shape, such as for example a round shape, sufficient to absorb a pre-determined level of sound from the front of the sound reflective band leader station 480.

The principle and mode of operation of this invention have been described in its preferred embodiments. However, it should be noted that this invention may be practiced otherwise than as specifically illustrated and described without departing from its scope.

What is claimed is:

1. A sound reflective acoustic panel comprising:

a panel having a scored surface, the scored surface including a plurality of substantially parallel spaced apart kerfs, the kerfs configured to allow the panel to flex, the panel having an arcuate cross-sectional shape;

a plurality of support ribs attached to the scored surface of the panel, the support ribs having an upper surface and a lower surface, the lower surface positioned against the panel and the upper surface opposing the lower surface, the upper surface and lower surface of the support ribs having the same arcuate cross-sectional shape as the panel;

a suspension mechanism attached to the support ribs and suitable for mounting the panel to a building support surface.

2. The sound reflective acoustic panel of claim 1 in which a plurality of panel anchors are attached to the plurality of support ribs along the length of the support ribs.

3. The sound reflective acoustic panel of claim 2 in which a plurality of suspension members are attached to the plurality of panel anchors, wherein the suspension members attach the sound reflective acoustic panel to a building structure.

4. The sound reflective acoustic panel of claim 1 in which the panel is made of medium density overlay plywood.

5. The sound reflective acoustic panel of claim 4 in which the plywood has a thickness of 0.75 inches.

6. The sound reflective acoustic panel of claim 1 in which the kerfs have a width and a depth, whereas the width is about 0.25 inches and the depth is about 0.50 inches.

7. The sound reflective acoustic panel of claim 1 in which the kerfs are spaced apart a distance of about 1.0 inches on center.

8. The sound reflective acoustic panel of claim 1 in which the support ribs are made of square tube.

9. The sound reflective acoustic panel of claim 1 in which the support ribs have a concave shape.

10. The sound reflective acoustic panel of claim 1 in which the panel has a length and the support ribs have a length, wherein the length of the panel is longer than the length of the support ribs.

11. The sound reflective acoustic panel of claim 2 in which each panel anchor has an aperture.

12. The sound reflective acoustic panel of claim 3 in which the suspension members are wires.

13. Sound reflective acoustic panels comprising:

a plurality of sound reflective acoustic panels, each panel having a scored surface, the scored surface of each panel including a plurality of parallel spaced apart kerfs, the kerfs configured to allow each panel to flex, each panel having a plurality of support ribs, each support rib having a curved shape and a length, wherein adjacent panels are aligned with respect to each other with at least some of the panels in a flexed condition; and a plurality of joining clips attached to the scored surface of the panels, each joining clip having an alignment lip, wherein the joining clips attached to one panel alternate with the joining clips attached to an adjacent panel.

14. The sound reflective acoustic panel of claim 1 in which the panel has an s-shaped cross-sectional shape and the upper surface and lower surface of the support ribs have the same s-shape cross-sectional shape as the panel.

* * * * *